United States Patent [19]

Backus

[11] 4,125,358

[45] Nov. 14, 1978

[54] OIL BURNER

[76] Inventor: Thomas R. Backus, Port Rowan, Canada

[21] Appl. No.: 762,318

[22] Filed: Jan. 25, 1977

[30] Foreign Application Priority Data

Jan. 30, 1976 [CA] Canada ..... 244843

[51] Int. Cl.[2] ..... F23D 11/04

[52] U.S. Cl. ..... 431/168; 239/224

[58] Field of Search ..... 431/8, 9, 168, 169; 239/222.11, 222.13, 223, 214, 224

[56] References Cited

U.S. PATENT DOCUMENTS

| | | | |
|---|---|---|---|
| 762,048 | 6/1904 | Gibbs | 431/168 |
| 1,695,030 | 12/1928 | Scheminger | 431/168 |
| 2,072,587 | 3/1937 | Greenawalt | 431/168 X |
| 2,815,806 | 12/1957 | McGillis et al. | 431/168 X |

*Primary Examiner*—Edward G. Favors

*Attorney, Agent, or Firm*—Hirons & Rogers

[57] ABSTRACT

An oil burner which operates on all grades of fuel oil, even dirty oil, has a rotating burner element spinning in a hollow container, with the fuel oil being fed to the burner element. Air is fed in from below. The burner element is of fan-like form with radially extending vanes, and causes forcible recirculation of the burning gases through the fire zone repeatedly, so as to ensure complete combustion.

3 Claims, 2 Drawing Figures

OIL BURNER

FIELD OF THE INVENTION

This invention relates to oil burners, of the type in which fuel oil is vaporized and mixed with air and ignited continuously in a combustion zone.

BACKGROUND OF THE INVENTION

It is known to provide oil burners in which the fuel oil is supplied to a spinning rotary element, where the oil is atomized (i.e. vaporized, or reduced to the form of a spray). The atomized oil is mixed with air drawn into the burner, such mixing and ignition of the air/oil mixture taking place in the vicinity of the rotary element. Previously prepared oil burners of this type have, however, suffered from a number of disadvantages. For example, they have accomplished only incomplete combustion of the oil fuel. Whilst attempts have been made to design the parts of the apparatus so as to lead to recirculation of the combustible mixture through the combustion zone again after its first ignition, these have been only partially effective, and have lead to complications in structure of the apparatus. Further, problems have arisen with carbon build-up on the rotary element of the burner, necessitating frequent maintenance and cleaning for continued operation.

BRIEF DESCRIPTION OF THE PRIOR ART

U.S. Pat. No. 2,417,929 Hanson describes an oil burner in which the fuel oil is fed to an absorbent material, out of which it seeps in a fine mist for combustion. A fan is provided to circulate combustion air around the burner.

U.S. Pat. No. 3,330,323 Dennis shows a combustion chamber for an oil burner in which air is circulated through the fire zone as a result of the particular configuration of the structure.

U.S. Pat. No. 2,620,864 Ray describes a rotary oil burner in which the fuel oil is delivered into a spinning cup and mixed with combustion air. Since however this arrangement has the spinning element out of the hottest part of the combustion zone, it is likely to suffer from serious problems of carbon deposition.

U.S. Pat. No. 3,176,749 Downs discloses a burner arrangement using a rotating spinning disc to receive the fuel oil, and an absorbent pad to receive the oil droplets so formed. This arrangement also suffers from carbon deposition problems in use.

BRIEF SUMMARY OF THE INVENTION

The present invention provides an improved rotary oil burner, in which forcible recirculation of the burning gases through the combustion zone is effected, so as to ensure complete combustion of the fuel. This is achieved by providing a rotary element in the general form of a fan, which draws in the air and mixes it with oil fuel vaporized or atomized by impingement on the rotary element. Mixing is effected in the vicinity of the rotary element. The rotary element actually operates within the combustion zone, and runs so hot that it substantially prevents carbon deposits thereon.

Thus according to the present invention, there is provided an oil burner comprising:

a hollow container;

a rotary burner element mounted for rotation within the container, the element being fan-like form, having an upper portion, a lower portion and radially extending fins;

means for feeding oil fuel to the upper portion of the element as the element is rotated, to cause atomization and radially outward movement of oil fuel to the periphery of the rotating element air inlet means below the lower portion of the rotary burner element;

the element being adapted to draw air to its lower portion and move it radially outwardly of the element to mix with the atomized fuel in the vicinity of the periphery of the element as the element rotates;

means for firing the mixture of fuel and air to burn in the vicinity of the rotating element;

the rotating element being so constructed and arranged as to cause recirculation of the burning fuel/air mixture around and through the rotating element.

The rotary burner element, in operation, spins in the combustion zone and becomes very hot, so that it assists in igniting freshly introduced oil-air mixtures. The rotary burner element also serves to draw in the fresh air, atomise the oil fuel, mix the oil and air and cause the forcible, positive recirculation of the combustible mixture. Physical configurations of the oil burner container or combustion chamber are thus not relied upon to circulate the oil-air mixture back towards the combustion zone.

In order to prevent carbon build up in the rotary element as a result of the impingement of the oil fuel thereon and incomplete initial combustion, the upper portion of the rotary burner element of the present invention is run as hot as possible, in the fire zone. This prevents carbon deposits from forming and clogging the rotary parts, which would necessitate frequent stoppages for cleaning and maintenance. In practice, the upper portion of the rotary element preferably runs red hot.

DESCRIPTION OF THE PREFERRED EMBODIMENTS

To assist in ensuring the hottest practical operation of the upper portion of the rotary element, it is preferred to separate it from the lower portion thereof. Since the lower portion serves to draw in air for mixing with the vaporized fuel, it is consequently subject to continuous cooling by the incoming air. In order to prevent the lower portion exerting a cooling influence on the upper portion, therefore, it is preferred to separate them. This is conveniently accomplished by constructing the rotary burner element in two separable halves, and providing an item of low heat conductivity, such as an asbestos disc, between the two halves. The halves of the rotary burner element are suitably made of cast iron, or high temperature resistant ceramic material.

The means for feeding oil fuel is preferably a feed pipe, extending from a source of oil supply to a location above the upper portion of the rotary burner element. Oil fuel may be delivered, e.g. by pumping, from the feed pipe at a controllable rate. It is preferred to provide a means for feeding oil which is substantially free from small orifices, so that impure, dirt containing oil can be used as fuel without serious risk of plugging the feeding system.

The air inlet means is preferably a hollow tube extending from an aperture in the bottom wall of the container, to the vicinity of the lower portion of the rotary burner element. Means are provided for adjusting the size of the aperture to control the amount of air fed in, suitably in the form of an adjustable sliding cover plate at the aperture. A secondary air supply may also be provided, extending from outside the container to a position above the rotary burner element.

The device may be associated with a suitable heat exchanger or radiator, which supplies the generated heat to the room in which the burner operates, in an efficient manner. The heat exchanger may be mounted at the top of the container, and have suitable heat exchange tubes therein through which air is circulated for heating purposes, and which are heated by hot gases emanating from the container.

BRIEF REFERENCE TO THE DRAWINGS

DESCRIPTION OF THE PREFERRED SPECIFIC EMBODIMENT

Figure 1:
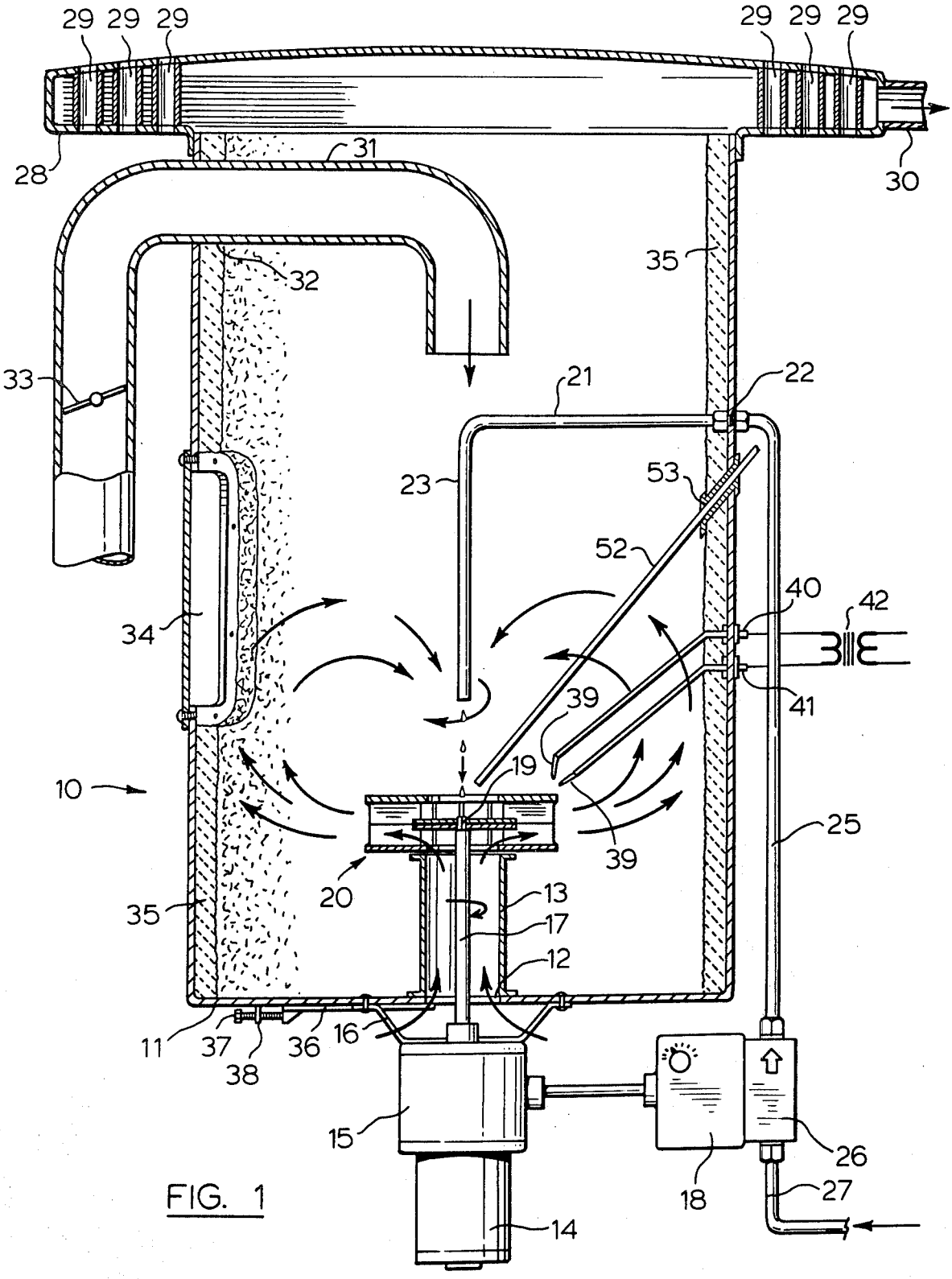
FIG. 1 is a vertical cross sectional view, somewhat diagrammatic, of an oil burner according to the present invention.

With reference to FIG. 1, the oil burner comprises a container 10 of drum-like form, generally circular as viewed in plan. The bottom wall 11 is centrally apertured at 12. An upstanding cylindrical pipe 13 extends upwardly inside the container 10, overlying the aperture 12 and providing an air intake passageway through which air can be drawn from the outside atmosphere into the interior of the container 10. The pipe 13 is mounted on the bottom wall 11 of the container 10.

A variable speed motor 14 and gear box 15 are mounted by means of a bracket 16 onto the bottom wall 11 of the container 10, below the bottom wall 11 and exteriorly of the container 10. A drive shaft 17 from the gear box 15 extends vertically upwardly through the centre of aperture 12 and pipe 13 into the container 10.

The drive shaft 17 extends upwardly beyond the upper end of cylinder 13, and terminates at its upper end in a square mounting formation 19. A rotor, generally indicated 20, is mounted on formation 19 on the end of drive shaft 17, for rotation therewith.

An oil feed tube 21 is provided, which extends through an aperture 22 near the top of the side wall of the container 10. The oil feed tube 21 has a downwardly extending portion 23 which extends downwardly at the approximate center axis of the container 10. The downwardly extending portion 23 of the oil feed tube 21 terminates a short distance above the centre of the rotor 20. Exteriorly of the container 10, the oil feed tube 21 has a vertical downwardly extending portion 25 extending down the exterior of the side wall of the container 10, and connected to the outlet side of a pump 26.

The inlet side of the pump 26 is connected to a pipe 27 communicating with a suitable fuel supply reservoir. The pump 26 is connected to speed control 18, and the rate of operation of the pump 26 controlled thereby.

The container 10 is fitted at its upper end with a heat exchanger 28, extending laterally of the container 10 at either side. The heat exchanger has passing therethrough a number of tubes 29, through which room air circulates.

The heat exchanger 28 at one lateral end is provided with an exhaust 30 for connection to a chimney.

An air inlet pipe 31 for supply of secondary air extends through an aperture 32 in the side wall of the container 10, and terminates in the upper portion of the container 10, substantially directly above the rotor 20. An adjustable air control 33 is provided the secondary air inlet pipe 31, to control the amount of air supplied from outside to the upper part of the container 10 through inlet pipe 31.

At one position in its side wall, the container 10 is provided with a large aperture covered by a removable cover plate 34. This is for inspection purposes, and to provide additional access to the interior of the burner for cleaning, dismantling etc.

Around the inside of the side wall, the container 10 is lined with a layer 35 of fire clay. The layer 35 extends from the bottom wall 11 upwardly to the top of the container 10.

On the lower side of the bottom wall 11 is mounted a slidable cover plate 36. The position of the cover plate 36 is adjustable by means of a screw 37 threadably received in a bracket 38, so that cover plate 36 can be adjusted to cover bottom aperture 12 to a greater or lesser extent as desired during operation.

There is also provided an electric ignition means in the form of a pair of closely spaced electrical points 39 located adjacent the top surface of the rotor 20. The points 39 are electrically connected to respective terminals 40,41 mounted on but insulated from the side wall of the container 10, and connected exteriorly to a source 42 of electric current. When electric current is thus supplied to points 39, sparking occurs between the points 39 for ignition purposes.

Figure 2:
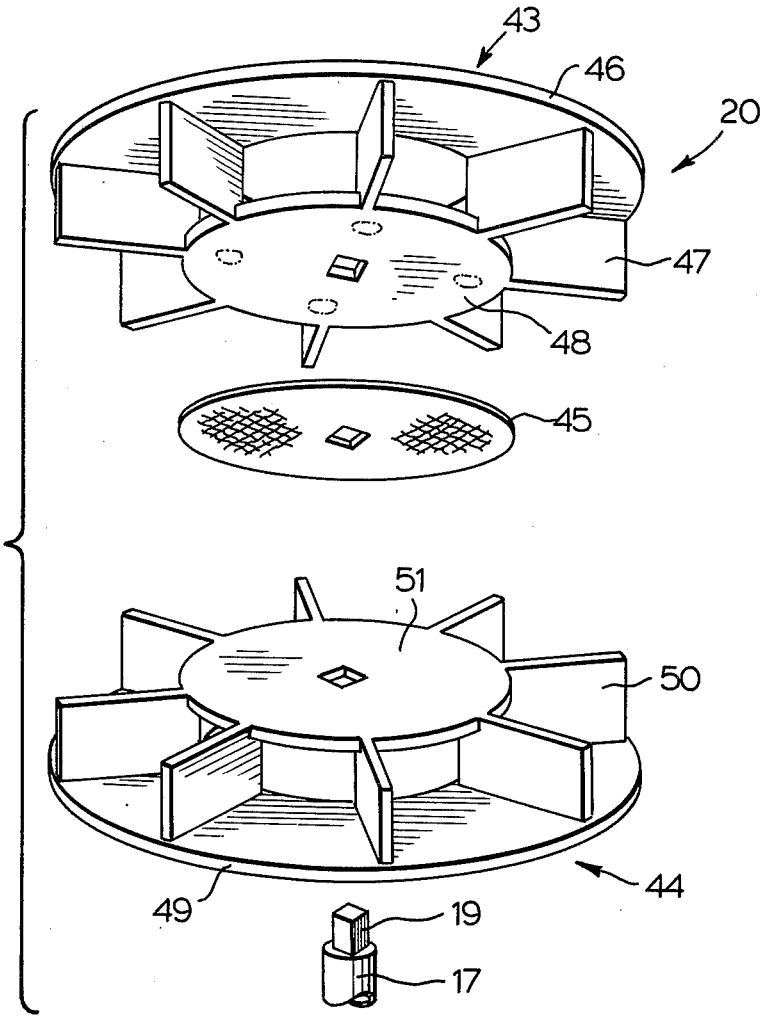
FIG. 2 is an exploded perspective view of the rotor of the oil burner of FIG. 1.

The rotor 20, as illustrated in more detail in FIG. 2, has an upper half 43 and a lower half 44, and a separation disc 45 between them. Each of these three components is circular as viewed in plan, and is centrally apertured with a square aperture so as to be drivingly engaged by the square mounting formation 19 on the upper end of the drive shaft 17.

The upper half 43 of the rotor 20 has an upper annulus 46 having on the lower surface thereof vertically depending, radially extending rectangular vanes 47. At their outer radial edges, the vanes 47 extend almost to the outer periphery of the upper annulus 46. A lower smaller disc 48 is provided, which is of slightly larger diameter than the aperture of the annulus 46. The generally rectangular vanes 47 are mounted on the lower smaller disc 48, by means of their lower inner corners, and thus serve to connect the annulus 46 to the lower disc 48. The lower edges of the vanes 47 are substantially flush with the lower surface of the lower disc 48.

The lower half 44 of the rotor 20 is substantially identical with the upper half 43, but reversed with respect thereto. Thus it has an annulus 49, upwardly extending vanes 50, and an upper smaller disc 51, disposed as described in connection with the upper half 43. Both the upper half 43 and the lower half 44 can be made as one piece castings, of cast iron.

When assembled, the upper half 43 and the lower half 44 are kept out of direct contact with one another, by means of separation disc 45 mounted between them and contacting the smaller discs 48,51. The separation disc 45 is of low heat conducting fire resistant material such as asbestos, to minimize heat transfer between the upper half 43 and lower half 44.

There is also provided a hot air feed tube 52 which extends downwardly from outside the container 10, through an aperture 53 therein to a location close to the centre of the rotor 20. The tube 52 is slidably adjustable in aperture 53, to extend closer to or further from the rotor 20. The tube 52 thus extends through the hot combustion zone, and supplies heated air to the rotor 20 as the rotor 20 spins.

The operation of the illustrated specific embodiment of the invention will now be described, with reference to the drawings.

The rotor 20 is assembled on the square mounting formation 19 of the drive shaft 17, as shown in FIG. 1. The drive shaft 17 is set rotating, at high speed (e.g. 900–1200 rpm) by means of motor 14, so as to cause high speed rotation of the rotor 20. The rotation of rotor 20 causes air to be drawn in, upwardly through aperture 12 and cylinder 13 from outside the container 10 to the rotor 20, and expelled radially outwardly of the rotor vanes 47,50. The pump 26 is activated to feed oil fuel through oil feed tube 21, from where it is drip fed from pipe 23 through the annulus 46 onto the spinning lower smaller disc 48 of the spinning rotor 20. By means of the impingement of the fuel on the spinning disc 48 of the rotor, the liquid fuel is atomized, and forced outwardly by the centrifugal force of the spinning rotor, and the action of the vanes 47. At the periphery of the spinning rotor 20, it mixes with the air fed outwardly from the rotor vanes 50 to form a combustible mixture. Initial ignition is caused by supplying electric current to the points 39 to create sparking. Now the burner will continue in operation, with fuel fed continuously onto the spinning rotor 20 from the drip feed pipe 23, and air drawn in continuously through cylinder 13 by rotor 20 and mixed with atomized fuel at the periphery of the spinning rotor 20.

As the combustion continues, the spinning rotor 20 causes forcible recirculation of the air-fuel vapor mixture from the periphery of the spinning rotor 20 upwardly, inwardly and downwardly to the center of the rotor 20 as indicated by the circulation arrows of FIG. 1. In effect, therefore, the flaming hot gases are circulated through the hot burner rotor and mixed with fresh incoming air several times. This mode of operation, due to this forcible recirculation, ensures high efficiency of operation, and substantially complete utilization of the liquid fuel supplied. Incomplete combustion of the fuel is avoided by this forcible recirculation of the vapor thereof to and through the hot combustion zone. Newly introduced fuel/air mixture is fired by means of the red hot running rotor which it contacts, and by mixing with already burning gases. The layer of fire clay heats up to a red hot condition, and serves to reflect radiant heat back to the combustion zone and rotor, to improve fuel vaporization, and also to reduce deterioration of the container walls due to heating.

In practice, the burner operation exhibits a fire inside the container 10 having a toroidal appearance, like a whirling donut, continually turning itself inside out. It burns with a hot blue flame even on the lowest grades of oil: in fact, waste automobile sump oil, without any cleaning to remove dirts and sludges therein, has been satisfactorily used in the apparatus according to the invention.

The asbestos separation disc 45 increases the efficiency of the burner by permitting the top half 43 of the rotor 20 to become as hot as possible. The bottom half 44 must of necessity be subject to cooling, since it is contacted by the incoming stream of fresh air from cylinder 13. The separation disc 45 prevents excessive cooling of the top half 43 by the bottom half 44. Such separation of the two halves of the rotor permits the top half 43 of the rotor to run as hot as possible, not only to obtain good atomization of fuel, but also to maintain the top half 43 substantially free of carbon deposits. Burning off of carbon deposits from the rotor is also assisted by the supply of hot air to the vicinity of the rotor through tube 52. The spinning rotor draws air downwardly through tube 52, and the air is heated by passage therethrough. The amount of air supplied in this manner is controlled by the slidable positioning of tube 52 in aperture 53. This serves to make the burner run cleanly and reduce ordours therefrom due to incomplete combustion, even on dirty fuel. This cleanliness of operation ensures that the burner can be run for extended periods of time without requiring cleaning or maintenance of the parts thereof.

The control of the amount of heat generated by the burner is readily achieved by adjusting the speed of the rotor, and the air inlet 12, by adjustment of sliding plate 36.

It is to be understood that the above described embodiment is a specific, illustrative embodiment according to the invention, and the invention is not limited thereto. For example, the motor and associated parts can be moved to a location generally above the bottom level of the burner and arranged to provide stability for the machine in operation. The upper air inlet may be found to be providing sufficient air during certain operating conditions, that the lower air inlet may be closed off completely once the burner is operating at high temperature. The invention is limited only by the scope of the appended claims.

I claim:

1. An oil burner comprising;

a hollow container;

a rotary burner element mounted for rotation within the container, the element being of fan-like form, having an upper portion, a lower portion and radially extending vanes, said upper portion of the rotary burner element comprising an upper annulus, radially extending, depending rectangular vanes secured thereto, and a lower and smaller disc mounted on the lower inner corners of the rectangular vanes, and the lower portion and the upper portion being separated from one another;

an oil feed pipe for feeding oil fuel to the upper portion of the element as the element is rotated, to cause atomization and radially outward movement of the oil fuel to the periphery of the rotating element;

air inlet means below the lower portion of the rotary burner element and comprising a hollow tube extending from an aperture in the bottom wall of the container to the vicinity of the lower portion of the rotary burner element, and provided with means for adjusting the size of the aperture;

the element being adapted to draw air to its lower portion and move it radially outwardly of the element to mix with the atomized or vaporized fuel in the vicinity of the periphery of the element as the element rotates;

means for firing the mixture of fuel and air to burn in the vicinity of the rotating element;

the rotating element being so constructed and arranged as to cause recirculation of the burning fuel air mixture around the rotating element.

2. The oil burner of claim 1, wherein the lower portion of the rotary burner element is of substantially the same form as the upper portion thereof, but revesed with respect thereto.

3. The oil burner of claim 2, provided with a motor and drive shaft on which the rotary burner element is mounted, speed control means for varying the speed of rotation of the drive shaft, and pumping means for delivering oil fuel through the feed pipe to the rotary burner element.

* * * * *